United States Patent [19]

Tassotti et al.

[11] Patent Number: 4,815,487

[45] Date of Patent: Mar. 28, 1989

[54] WASH TUB FOR A DISHWASHER

[75] Inventors: Sergio Tassotti; Roberto Sgobaro, both of Pordenone, Italy

[73] Assignee: Industrie Zanussi S.p.A., Pordenone, Italy

[21] Appl. No.: 151,500

[22] Filed: Feb. 2, 1988

[30] Foreign Application Priority Data

Feb. 2, 1987 [IT] Italy ..... 34005 B/87

[51] Int. Cl.[4] ..... B08B 3/00; B65D 90/02

[52] U.S. Cl. ..... 134/180; 220/83; 312/305

[58] Field of Search ..... 134/180, 181; 220/83; 312/125, 135, 197, 305

[56] References Cited

U.S. PATENT DOCUMENTS

| | | | |
|---|---|---|---|
| 2,380,005 | 7/1945 | Wilson | 312/305 |
| 2,537,378 | 1/1951 | Staltare | 312/305 |
| 2,537,489 | 1/1957 | Taylor | 312/305 |
| 2,641,268 | 6/1953 | Hellyer | 134/180 |

FOREIGN PATENT DOCUMENTS

| | | | |
|---|---|---|---|
| 0554842 | 1/1957 | Italy | 134/181 |

*Primary Examiner*—Jimmy G. Foster

*Attorney, Agent, or Firm*—Wenderoth, Lind & Ponack

[57] ABSTRACT

A wash tub for a dishwasher has a rectangular cross section and houses a spray arm rotatable about an axis adjacent to the center of such cross section. Larger side walls of the tub are provided with recesses capable of receiving the end portions of the spray arm during rotation thereof. The length and washing effectiveness of the rotary spray arm are increased.

5 Claims, 1 Drawing Sheet

WASH TUB FOR A DISHWASHER

BACKGROUND OF THE INVENTION

The present invention relates to a wash tub for a dishwasher, particularly a household dishwasher.

As is known, household dishwashers are usually provided with a wash tub of substantially parallelepipedonal shape having an open side which can be closed by means of a loading door. The tub houses one or more spray arms each of which is rotatable in a substantially horizontal plane and associated with a respective basket for supporting dishes or items to be cleaned.

The wash tub generally has a substantially square cross section the center of which generally coincides with the axis of rotation of the spray arms, the latter having lengths, just less than a side of the tub. In this way it is possible to make the most of the hydraulic action of the spray arms, while keeping to a minimum the area of the cross section of the tub which is not acted on by the spray arms during their rotation.

Recently, the suitability has arisen of providing household dishwashers of reduced size, in particular as far as their width is concerned. Such dishwashers are substantially identical to the traditional ones, except for their wash tub which has a rectangular base, i.e. a rectangular cross section. Of course, the length of the spray arms must be slightly less than the shorter sides of the rectangular cross section, so that the spray arms can rotate within the tub. As a consequence, the area of the cross section of the tub which is not acted on or swept by the rotation of the spray arms is undesirably increased, with a corresponding reduction in the washing effectiveness of the spray arms themselves.

SUMMARY OF THE INVENTION

It is an object of the present invention to provide a wash tub for a dishwasher having a rectangular cross section, and capable of being used in association with rotary spray arms the washing effectiveness of which is kept at an optimum.

According to the invention, this object is achieved by providing a wash tub for a dishwasher of substantially parallelepipedonal shape and having a rectangular cross section, the tub housing at least one spray arm rotatable about an axis extending adjacent to the center of the cross section. Larger side walls of the tub are provided, at least in the area of the plane of rotation of the spray arm, with respective outwardly extending recesses capable of receiving the end portions of the spray arm during rotation thereof.

BRIEF DESCRIPTION OF THE DRAWINGS

Other objects, features and advantages of the present invention will become more evident from the following description, which is given only as a non-limiting example, with reference to the accompanying drawings, wherein.

DETAILED DESCRIPTION OF THE INVENTION

Figure 1:
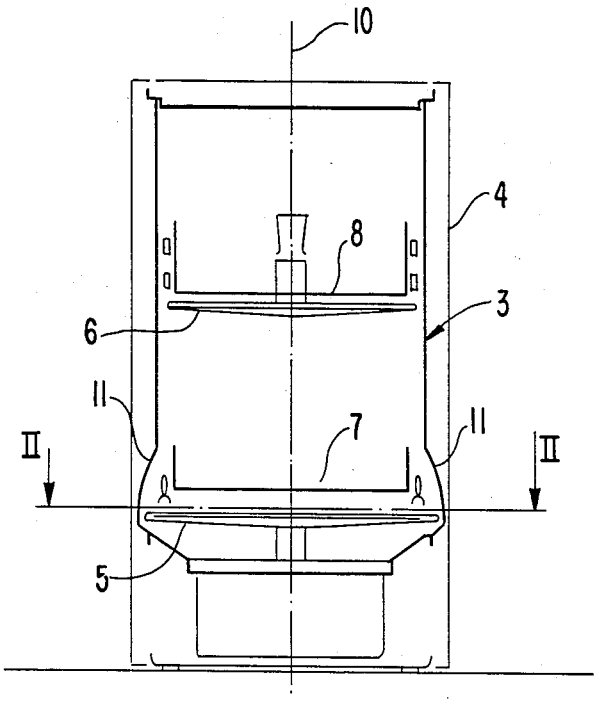
FIG. 1 is a diagrammatic illustration in longitudinal section of a dishwasher provided with a wash tub according to a preferred embodiment of the invention.
Figure 2:
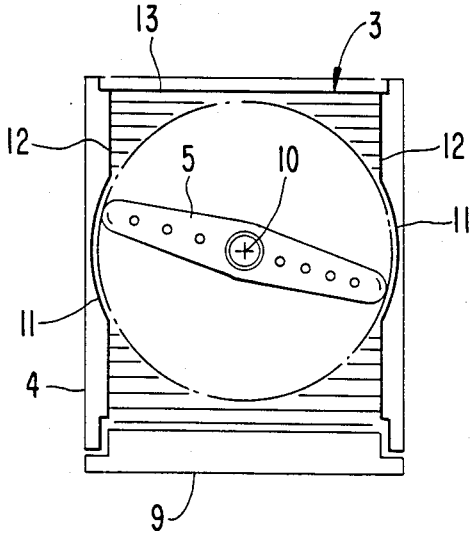
FIG. 2 is a cross section of the dishwasher of FIG. 1, taken along lines II—II therein.

With reference to FIGS. 1 and 2, a wash tub 3 is housed in a support cabinet 4 of a dishwasher and is interiorly provided with a lower rotary spray arm 5 and an upper rotary spray arm 6. In a traditional manner, the spray arms 5 and 6 are capable of sprinkling dishes (not shown) to be supported in respective baskets 7 and 8.

The wash tub 3 and the cabinet 4 of the machine each have a substantially parallelepipedonal shape with an open front side which can be closed by means of a loading door 9 (see FIG. 2). The tub 3 has a substantially rectangular base, or cross section, and the axis of rotation 10 of the spray arms 5 and 6 is adjacent the center of such rectangular base. Particularly, as shown in FIG. 2, the axis of rotation 10 preferably is positioned slightly backwardly with respect to the door 9.

The larger side walls 12 of the tub 3 are provided, at least in the area of the plane of rotation of the lower spray arm 5 (which plane could even be inclined), with respective outwardly extending recesses 11 capable of receiving the end portions of the spray arm 5 during rotation thereof. Preferably, the recesses are housed within the volume of cabinet 4 and the recesses 11 each have a cross section in the form of a circular segment concentric to the axis of rotation 10 of the lower spray arm 5. Thus, it is possible to employ a spray arm 5 which is longer than the shorter sides 13 of the cross section of the tub 3. As a consequence, the area of such cross section that is not swept by the spray arm 5 during its rotation (this area being hatched in FIG. 2) advantageously is reduced to a minimum. Of course, this results in the items or dishes supported by the basket 7 being more effectively washed. This is acceptable since, as is known, these items are usually more soiled than the items supported by the upper basket 8.

Obviously, the wash tub described above may undergo several modifications without departing from the scope of the present invention. For instance, the upper spray arm 6 may be as long as the lower spray arm 5. In such case the wash tub 3 would be provided, at a suitable height, with further recesses in its larger side walls 12, similar to recesses 11. As an alternative, the recesses 11 shown in FIG. 1 may extend upwardly at least to the plane of rotation of the upper spray arm 6. Of course it is also possible that the recesses 11 could be provided only in the area of the upper spray arm 6.

Finally, it is to be noted that the wash tub according to the invention may advantageously be applied to dishwashers of whatever size, whenever it is desired to use rotary spray arms having an increased length and, consequently, an increased washing effectiveness.

Although the present invention has been described and illustrated with respect to preferred and alternative arrangements, it is to be understood that other changes and modifications may be made to the illustrated and described arrangements and alternatives without departing from the scope of the invention.

We claim:

1. In a wash tub for a dishwasher, said tub having a substantially parallelepipedonal shape with a rectangular horizontal cross section defined by shorter and larger side walls, said tub housing at least one spray arm rotatable about an axis located adjacent to the center of said cross section, the improvement wherein:

said larger side walls of said wash tub are provided, at least in the area of the plane of rotation of said spray arm, with respective outwardly extending recesses receiving end portions of said spray arm during rotation thereof.

2. The improvement claimed in claim 1, wherein each said recess has a cross section in the form of a circular segment concentric to said axis of rotation of said spray arm.

3. The improvement claimed in claim 1, wherein said rotary spray arm is longer than said shorter side wall of said rectangular cross section.

4. In a wash tub for a dishwasher, said tub having a substantially parallelepipedonal shape with a rectangular horizontal cross section defined by shorter and larger side walls, said tub adapted to house therein at least one spray arm rotatable about an axis extending adjacent to the center of said cross section, the improvement wherein:

said larger side walls of said wash tub are provided, at least in the area thereof to correspond to the plane of rotation of the spray arm, with respective outwardly extending recesses capable of receiving the end portions of the spray arm during rotation thereof.

5. The improvement claimed in claim 4, wherein each said recess has a cross section in the form of a circular segment concentric to the axis of rotation of the spray arm.

* * * * *